US007971877B2

(12) United States Patent
Grob

(10) Patent No.: US 7,971,877 B2
(45) Date of Patent: Jul. 5, 2011

(54) TRANSFER OUT DEVICE

(75) Inventor: Mathias Grob, Seaford, VA (US)

(73) Assignee: Müller Martini Holdings AG, Hergiswil (CH)

( * ) Notice: Subject to any disclaimer, the term of this patent is extended or adjusted under 35 U.S.C. 154(b) by 1115 days.

(21) Appl. No.: 10/874,750

(22) Filed: Jun. 24, 2004

(65) Prior Publication Data

US 2005/0035029 A1 Feb. 17, 2005

(30) Foreign Application Priority Data

Jun. 25, 2003 (EP) ..... 03405461

(51) Int. Cl.
*B65H 9/16* (2006.01)

(52) U.S. Cl. ..... 271/248; 198/360

(58) Field of Classification Search ..... 270/52.04, 270/52.06, 52.29, 58.29; 198/418.6, 360, 198/369.3

See application file for complete search history.

(56) References Cited

U.S. PATENT DOCUMENTS

| | | | | | |
|---|---|---|---|---|---|
| 3,404,775 | A | * | 10/1968 | McClellan | 198/369.2 |
| 3,816,866 | A | * | 6/1974 | Miaskoff et al. | 412/12 |
| 3,921,809 | A | * | 11/1975 | Smith | 209/633 |
| 4,756,399 | A | * | 7/1988 | Scata | 198/369.2 |
| 4,792,392 | A | * | 12/1988 | Belgian | 209/3.3 |
| 4,838,435 | A | | 6/1989 | Alexandre et al. | |
| 5,024,316 | A | * | 6/1991 | Scata et al. | 198/369.3 |
| 5,277,871 | A | | 1/1994 | Fujii et al. | |
| 5,292,008 | A | * | 3/1994 | Sansone et al. | 209/584 |
| 5,342,278 | A | | 8/1994 | Kurandt | |
| 5,624,366 | A | * | 4/1997 | Beeri | 493/23 |
| 5,628,408 | A | * | 5/1997 | Planke et al. | 209/522 |
| 6,003,681 | A | * | 12/1999 | Wilbur et al. | 209/639 |
| 6,015,039 | A | * | 1/2000 | Bonnet | 198/368 |
| 6,235,998 | B1 | * | 5/2001 | Brewer | 177/103 |
| 6,554,123 | B2 | * | 4/2003 | Bonnet | 198/370.04 |
| 6,891,119 | B2 | * | 5/2005 | Grubbs et al. | 209/587 |
| 2002/0066649 | A1 | * | 6/2002 | Grubbs et al. | 198/836.1 |
| 2002/0170850 | A1 | * | 11/2002 | Bonham et al. | 209/589 |

FOREIGN PATENT DOCUMENTS

| | | | | |
|---|---|---|---|---|
| CH | 657 598 | A5 | | 9/1986 |
| DE | 37 21 391 | A1 | | 1/1989 |
| GB | 1 496 243 | A | | 12/1977 |
| GB | 2240530 | A | * | 8/1991 |
| GB | 2 289 032 | A | | 11/1995 |
| JP | 62 016983 | A | | 1/1987 |
| JP | 64-007981 | A | | 11/1989 |
| JP | 08-020426 | A | | 1/1996 |

* cited by examiner

*Primary Examiner* — Stefanos Karmis
*Assistant Examiner* — Thomas A Morrison
(74) *Attorney, Agent, or Firm* — Venable LLP; Robert Kinberg; Kyle D. Petaja

(57) ABSTRACT

A device to transfer printed products out of the transport channel of a gathering and collating machine in which the printed products are transported in a clocked flow comprises an arrangement for transferring the printed products in a downward direction out of the transport channel. The printed products are preferably removed through an opening in a bottom part of the transport channel, wherein the opening is provided with a flap that can be pivoted downward and away from a product guide wall of the transport channel for the transfer out of a printed product.

20 Claims, 5 Drawing Sheets

TRANSFER OUT DEVICE

CROSS-REFERENCE TO RELATED APPLICATION

This application claims the priority of European Patent Application No. 03405461.9, filed on Jun. 25, 2003, the subject matter of which is incorporated herein by reference.

BACKGROUND OF THE INVENTION

The invention relates to a device for transferring printed products out of the transport channel of a gathering and collating machine in which the printed products are moved along in a timed flow.

Transfer out devices of the aforementioned type have been known for a long time. They are used to transfer printed products that are defective or used for control purposes out of the transport channel and, in particular, to pull stacks or individual sheets from the timed flow without interrupting the production. With this type of transfer out device, the printed products are generally transferred out of the transport channel either perpendicular to the printed product in an upward direction, or parallel to the surface of the printed product toward the side, or at a slant in an upward direction. The change in direction during the transfer out is guided either by flaps that can be activated or by gripping elements that act in a perpendicular direction upon side areas of the printed products.

A transfer out device of this type is disclosed, for example, in reference DE 37 21 391 A. This transfer out device comprises a clamping system consisting of front and a rear clamping devices provided with clamping grippers that act jointly in pairs under the force of a spring element. The printed products to be transferred out are gripped with these clamping grippers.

A transfer out device is also known from reference CH 657 598 A, the transfer out device being provided with a conveyor, arranged at an angle to the transport channel, for transferring out the printed products. The conveyor has an endlessly circulating chain, which is held at both ends by chain wheels and forms a component of a branch conveyor. A plurality of branch-off pins that can be pivoted between a pulled back position and an extended position are arranged on the endless chain. In the extended position, the branch-off pins grip defective stacks to remove them from the transport channel.

With the transfer out device according to reference DE 37 21 391 A, it is possible per se to separate out defective printed products, and in particular stacks of printed products, without interrupting the operation of the gathering and collating machine. Since the thicknesses of the printed products, generally stacks of several printed sheets, can vary considerably, the transfer out device must be designed such that it can adapt to the thickness of the printed products to be transferred out, thus requiring a relatively expensive and involved design.

SUMMARY OF THE INVENTION

It is therefore the object of the present invention to create a transfer out device of the aforementioned type which can be produced cheaply and is nevertheless operatively sound. The transfer out device must operate reliably even if stacks with very different thicknesses are transported one behind the other in the transport channel. In addition, the device should be suitable for different formats and, in particular, for printed products having different back lengths.

For a transfer out device for transferring printed products out of the transport channel of a gathering and collating machine in which the printed products are transported in a timed flow, this object is achieved by means for transferring the printed products in a downward direction out of the transport channel. With the transfer out device according to the invention, the printed products are removed and/or transferred out of the transport channel in a downward direction. The printed products to be transferred out do not have to be gripped with clamps or gripped between conveying belts, but can be removed with the aid of gravity in a downward direction and can be conveyed away, for example, on a belt conveyor arranged below the transport channel. Not only products with very different thicknesses, but also products with different formats and, in particular, printed products with different back lengths, can therefore be removed with this device without requiring an involved design and configuration.

A particularly simple design is obtained according to one modification of the invention if the products can be transferred out through an opening in the transport channel.

According to another modification of the invention, the transport channel is provided in the region of the opening with a bottom section that can be moved downward for transferring out a printed product as soon as the printed product is positioned at least in part on the bottom section.

A design that is particularly sound with respect to operation is obtained if the aforementioned bottom section is a pivoting flap, wherein the flap is advantageously positioned such that it can pivot back and down for transferring out a printed product. If the flap is pivoted back and down perpendicular to the transporting direction, then the aforementioned opening is freed, and the product to be transferred out drops downward out of the transport channel due to gravity.

According to another modification of the invention, the transfer out of the printed products is aided by a blowing device, preferably arranged above the aforementioned opening.

According to one modification of the invention, at least one slide is arranged on the transport channel for displacing the printed products to be transferred out in a crosswise direction to the transport channel. The printed products are displaced with the slide in the direction of the aforementioned opening, thus making it possible to transfer out even very small formats in an operatively sound manner.

According to yet another modification of the invention, the slide can be moved into the transport channel through at least one opening in a guide wall of the transport channel.

A particularly suitable embodiment is obtained if the slide is designed in the manner of a rake, and the above-mentioned guide wall is provided with several openings for individual fingers, or prongs, of the slide. The printed products can thus be transferred fast and with high precision into the aforementioned opening.

According to one modification of the invention, the slide moves along with the printed product in the conveying direction, thus resulting in a particularly safe and fast displacement of the printed products toward the opening.

Further advantageous features follow from the specification, claims and drawing.

BRIEF DESCRIPTION OF THE DRAWINGS

In the following, one exemplary embodiment of the invention is explained with the aid of the drawing, which shows in.

DETAILED DESCRIPTION OF THE INVENTION

Figure 1:
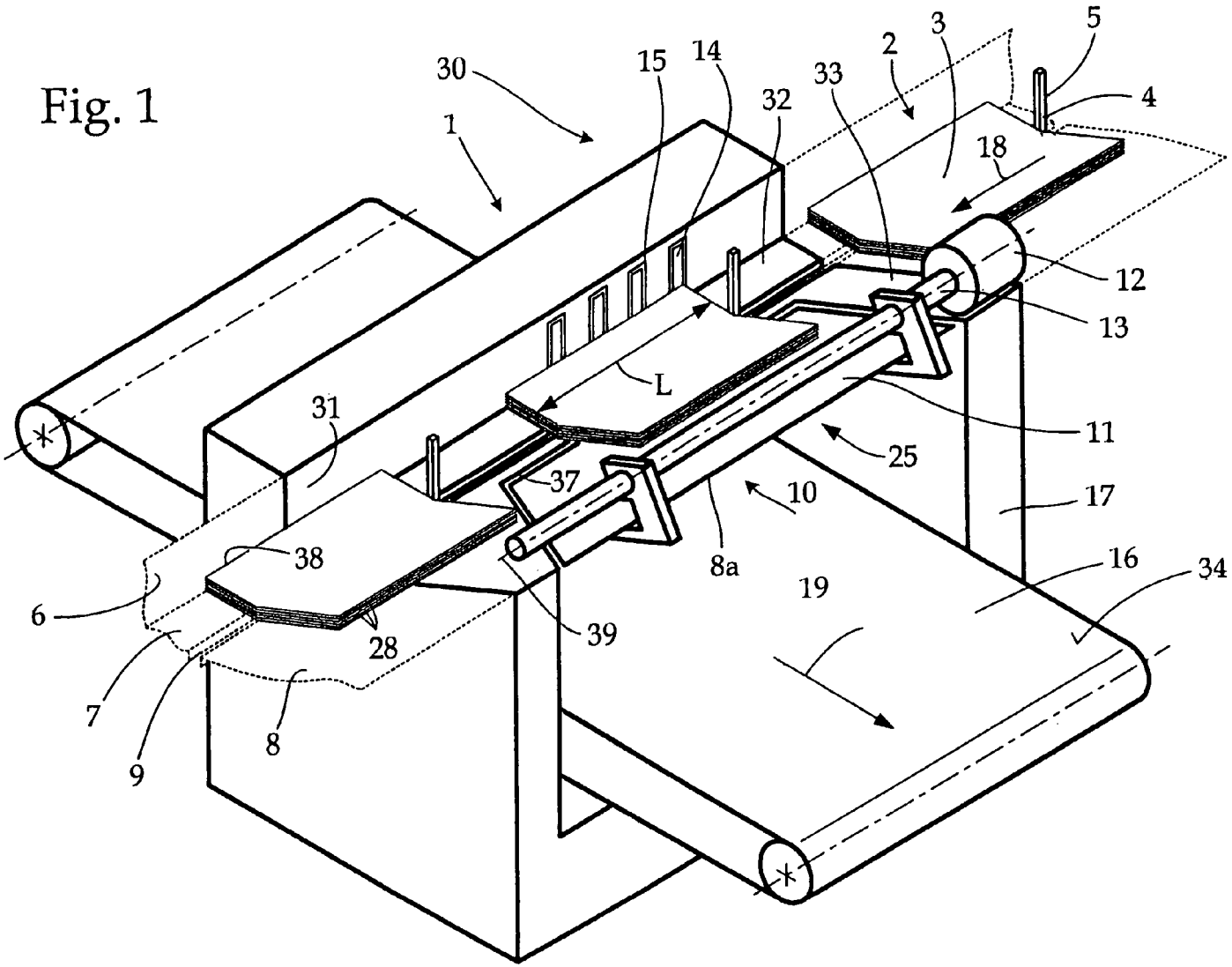
FIG. 1 a schematic three-dimensional view of a transfer out device according to the invention on a gathering and collating machine that is only indicated herein.

FIG. 1 shows a segment of a gathering and collating machine 30, known per se, provided with a transport channel 2 in which printed products 3 are transported continuously in a clocked flow in the direction of arrow 18. A transport device 4, for example, is used for the transporting in a known manner, wherein the transport device has several finger-shaped pushers, or driving pins, 5 that move the printed products 3 inside the transport channel 2. According to FIG. 5, the pushers 5 are mounted on an endless chain 24 and project upward through a slot 9 into the transport channel.

Figure 5:
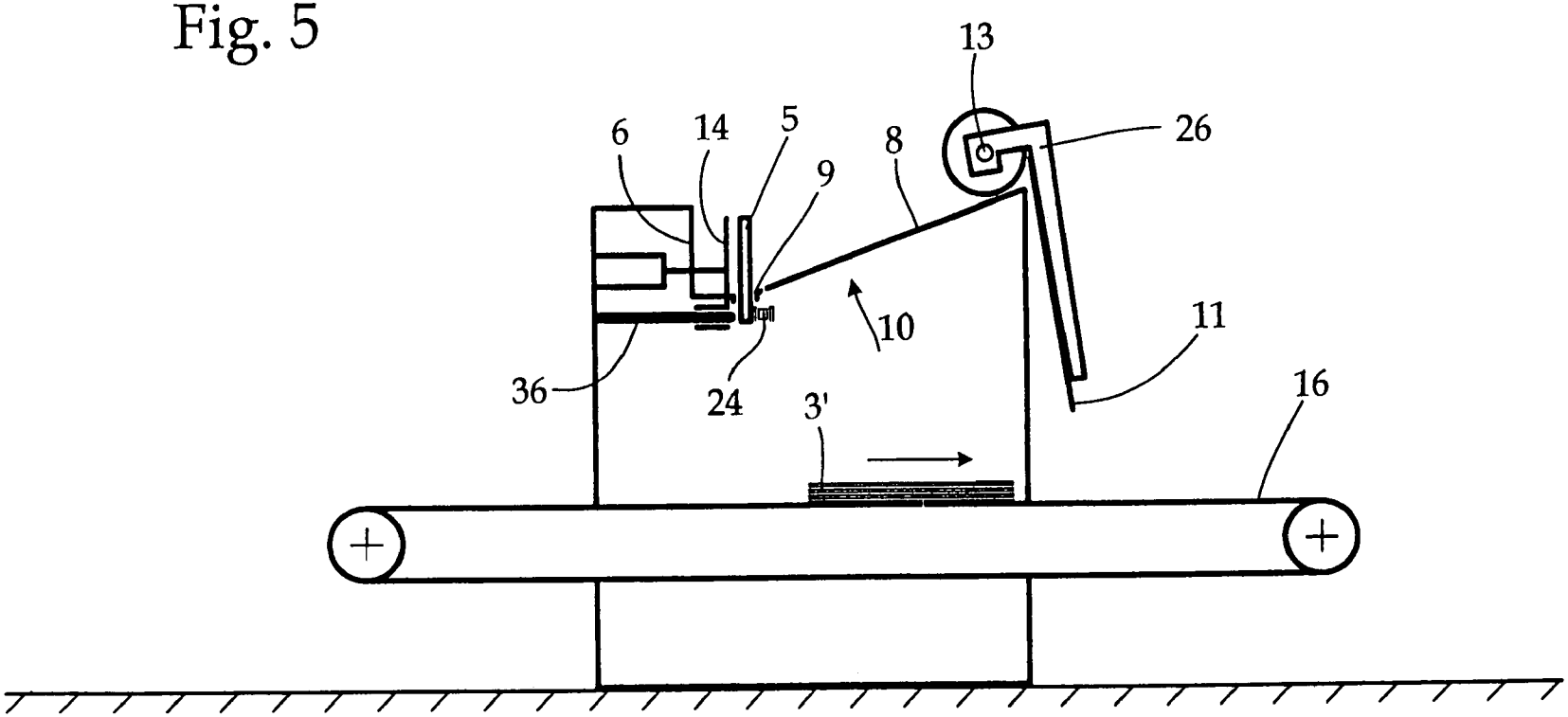
FIG. 5 a section through the transfer out device of FIG. 2.

The printed products 3 are, in particular, stacks of folded sheets 28, for example, used for producing books in a perfect binder, installed downstream, that is not shown herein. The back length of the printed products 3 is given the reference L in FIG. 1. The thickness of the printed products 3 and/or the stack can vary considerably, wherein a printed product 3 can also be a single sheet 28. During the transporting, the printed products 3 are guided with the back 38 along a guide wall 6 that projects upward, essentially perpendicularly, from a bottom part 7. The bottom part 7 is for the most part horizontal, and the printed products 3 in part rest on the bottom part 7, as can be seen. The largest area of the printed products 3 preferably rests on a bottom part 8 that is slanted upward, for example, at a small angle, as is shown in FIGS. 1 and 5. The printed products 3 accordingly are oriented toward the top in this region.

The gathering and collating machine 30 is provided with a transfer out device 1 that forms a segment of the transport channel 2. This transfer out device 1 comprises a frame 17 with a wall section 31 which replaces the guide wall 6 in the region of the transfer out device 1. Accordingly, the frame 17 also replaces the bottom parts 7 and 8 with corresponding wall sections 32 and 33. The transport channel 2 is, thus, not interrupted in the region of the transfer out device 1.

The transfer out device 1 functions to remove individual printed products 3 from the transport channel 2, wherein these printed products can be defective printed products or printed products removed for control purposes. Transferred out defective products can be repaired or used for other purposes. It is essential that the removal and/or transfer out of printed products can occur without having to stop the gathering and collating machine 30. As a result, the production is not interrupted during the removal of printed products 3.

The transfer out device 1 is provided in the transport channel 2 with an opening 10 with which a flap 11 is associated, the flap defining a section of a wall of the transport channel in which the opening 10 is provided. The flap is attached to a shaft 13 that is positioned on the frame 17 such that the shaft can rotate around an axis 39. The shaft 13 extends in the longitudinal direction of the gathering and collating machine 30 and is located outside of the region for printed products 3, as well as at a distance to the guide wall 6. The shaft 13 is furthermore located above the bottom part 8, approximately in the region of the exposed edge 8*a* of the bottom part 8. A motor 12 or other suitable drive can be used to rotate the shaft 13. In the idle position, the flap 11 complements the wall section 33 such that the printed products 3 can be transported without problems even in the region of the transfer out device 1. According to FIG. 1, the flap 11 is designed to correspond with the opening 10 and, in the upper end position, the top surface 27 of flap 11 is positioned in the same plane as the wall sections 33. Two angle-shaped arms 26, arranged at a distance to each other, to which the flap 11 is attached, serve to connect the flap 11 to the shaft 13.

Below the opening 10, a transport device 16, such as a belt conveyor, is arranged, for which the transporting direction is at a right angle to the transport channel 2, as indicated in FIG. 1 by the arrow 19. The transport surface 34 of transport device 16 is located below the opening 10.

Figure 2:
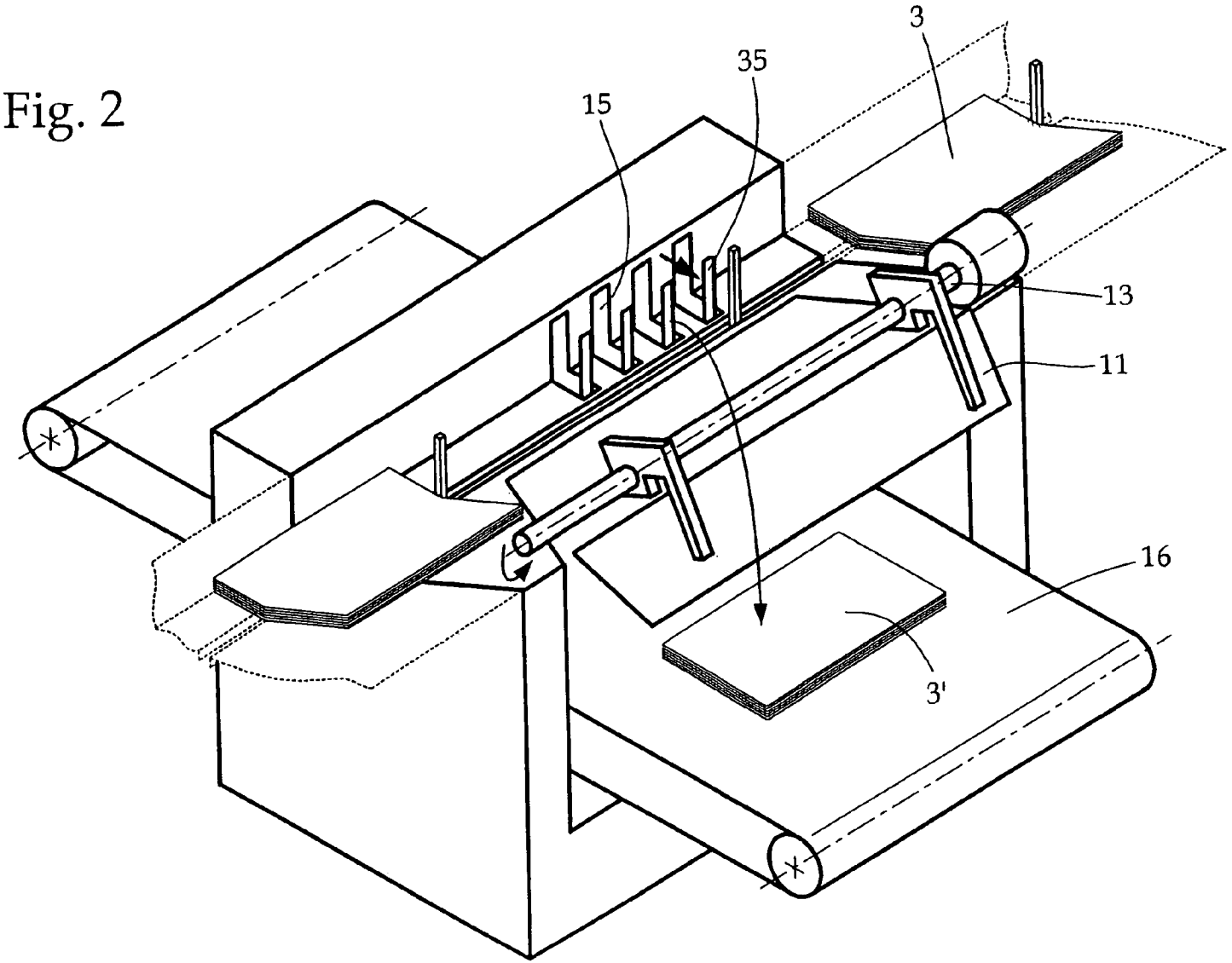
FIG. 2 a view similar to FIG. 1, but following the transfer out of a printed product.
Figure 3:
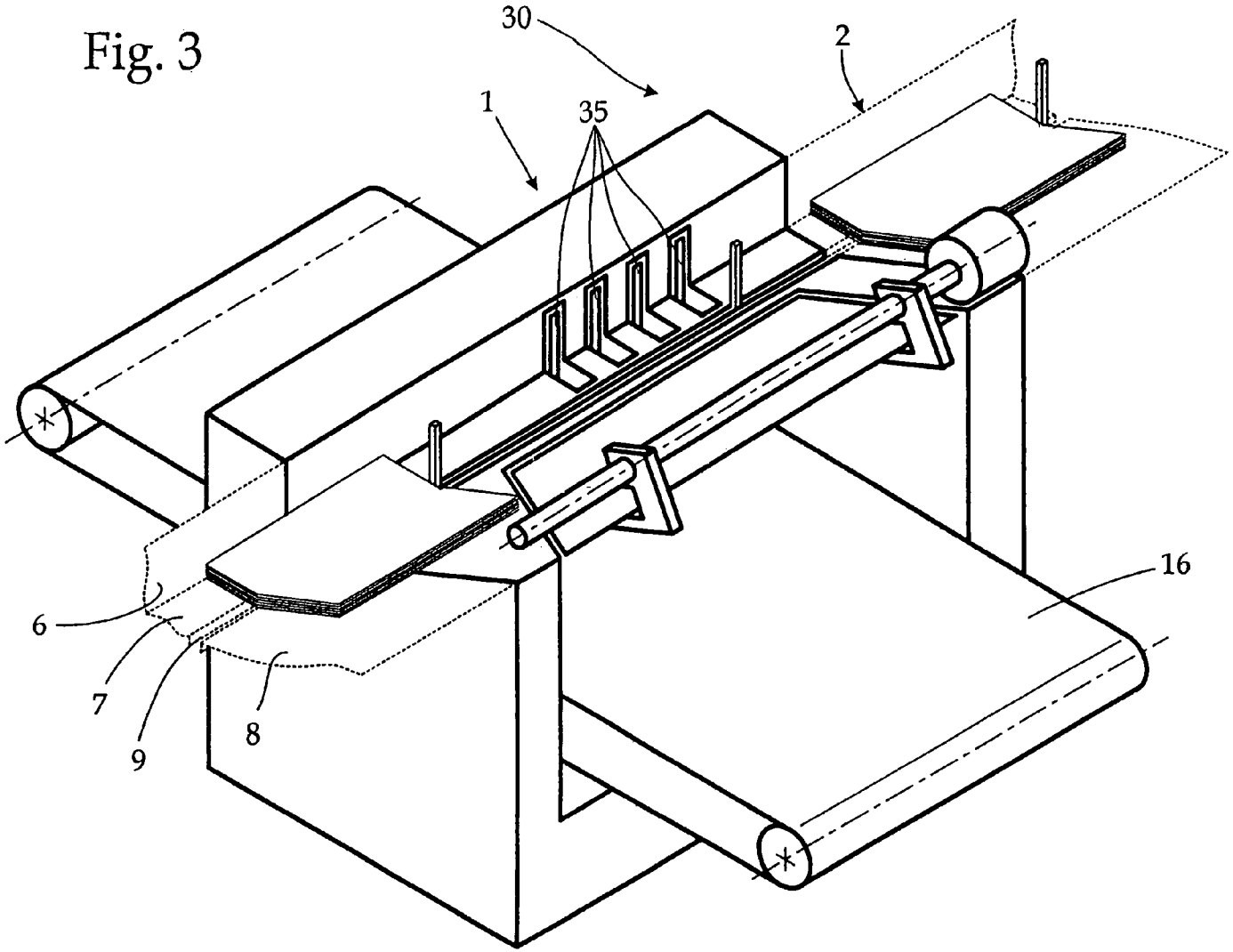
FIG. 3 a different view of the transfer out device according to the invention.

The flap 11 can be pivoted into the position shown in FIGS. 2 and 5 for transferring out a printed product 3. During this pivoting movement, the flap 11 is moved downward, as can be seen, so that the opening 10 is freed, or unobstructed. The pivoting of flap 11 is triggered by a signal from the control 23, indicated in FIG. 4, to the motor 12. If a printed product 3 is located above the opening 10 with the flap pivoted away, the printed product drops down due to gravity onto the transport device 16 and is then transferred out in the direction of arrow 19.

FIG. 2 shows a transferred out printed product 3' which is being conveyed away on the transport device 16. As a result, a gap is created in the product flow of printed products 3, as shown in FIG. 2.

Figure 4:
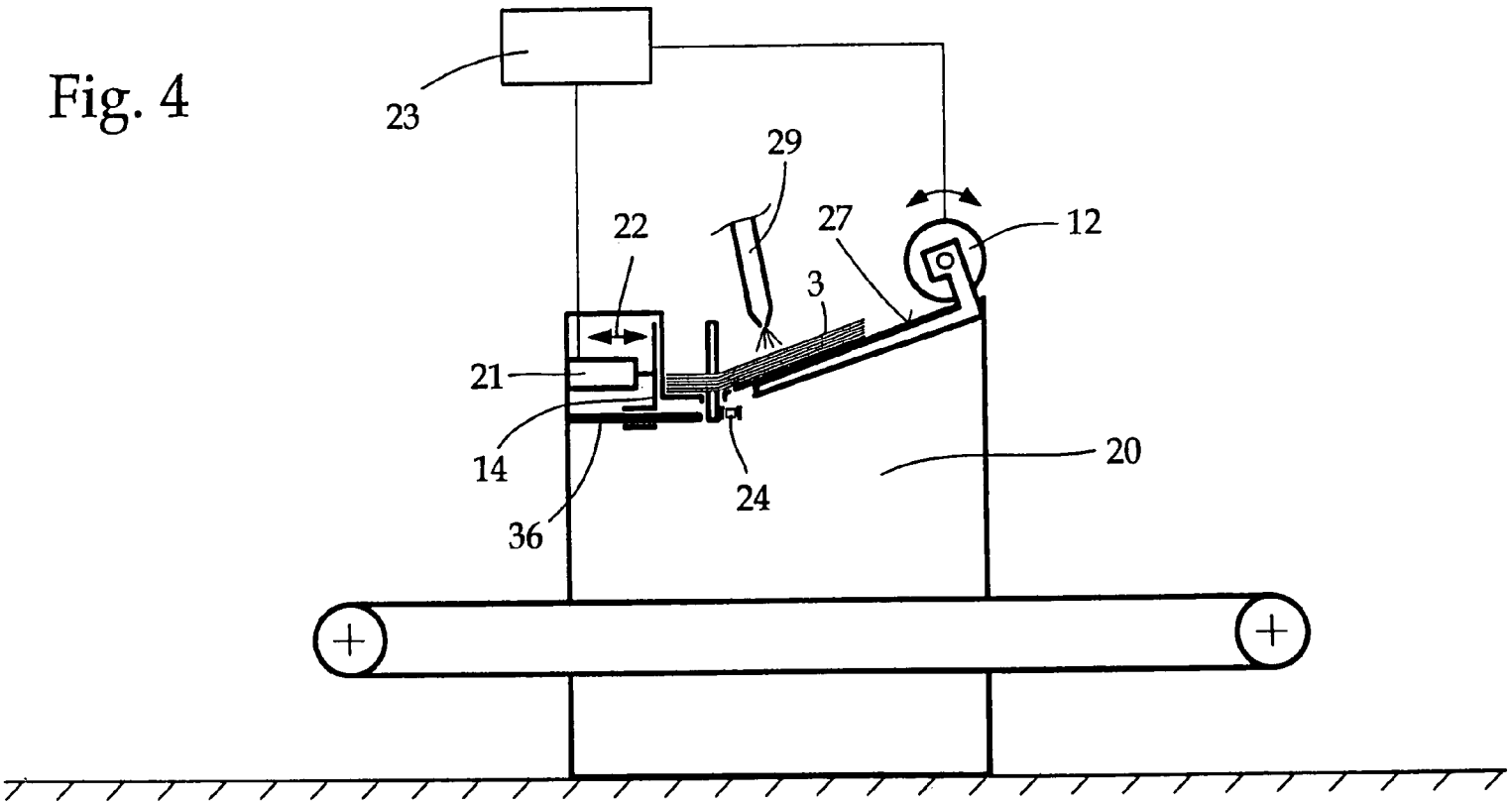
FIG. 4 a schematic vertical section through the transfer out device of FIG. 1.

A slide 14, in particular for removing small formats, is arranged in and/or behind the guide wall 6 and/or the wall section 31. The slide 14 is provided with several parallel fingers 35, similarly to a rake, which are arranged in corresponding recesses 15 of the wall section 31. The fingers 35 are arranged parallel to the wall section 31 and thus complement the wall section 31 in the idle position. The slide 14 is positioned on a guide 36 rigidly connected to the frame, and can be moved back and forth horizontally in the direction of double arrow 22 with the aid of at least one remotely activated drive, for example, an operating cylinder 21, as shown in FIG. 4. In one end position, the fingers 35 are positioned in the openings 15, while in the other end position, shown in FIG. 5, they are positioned in front of the wall section 31 and directly in front of the slot 9. The movement of slide 14 is also triggered by a signal from the control 23, wherein the slide 14 displaces the product at a right angle to the transporting direction in the transport channel 2. Alternatively, the slide 14 can be guided such that it moves with the printed product 3 in the transporting direction during the displacement of a printed product 3 to be transferred out, as shown with arrow 18. The slide 14 is additionally arranged near one edge 37 of opening 10 through which a printed product 3 drops for the transfer out. This edge 37 extends parallel to and at a relatively short distance from the slot 9. A printed product 3 to be transferred out can be pushed with the slide 14 against the edge 37 and, thus, into the opening 10. The movement of slide 14 and the pivoting movement of flap 11 are precisely coordinated during the removal operation, so that even small-format printed products 3 can be pushed reliably into the opening 10. As can be seen, the printed products 3 are pushed on their backs 38. During this sliding movement, caused by the slider 14, the printed product 3 to be transferred out is moved with the contacting pusher 5 in the direction of the transport channel 2. The resultant direction of these two movements thus extends crosswise to the transporting direction of transport channel 2 and pushes the respective printed product 3 into the opening 10, where it drops down onto the transporting device 16 as a result of gravity. The starting moments for pivoting the flap 11 and for displacing the slide 14 depend on the format and are computed and realized by the control 23 on the basis of the format. This is true for the forward movements and the backward movements of the slide 14 and the flap 11. Following the transfer out, the slide 14 and the flap 11 are immediately moved back to the starting position shown in FIG. 1. The transfer out device 1 is thus again ready for another removal operation.

The transfer out device 1 can be used to transfer out individual printed products 3 and, of course, also several printed products 3 successively, wherein the transfer out can be automatic or manual. Defective printed products 3 can be detected, for example with sensors, and can be transferred out of the transport channel 2 with the aid of corresponding signals sent to the control 23. For control purposes, the control 23 can also be configured such that it automatically transfers out respective printed products 3.

According to FIG. 4, the transfer out of the printed products 3 can be accelerated by using one or several blow nozzles 29 which are arranged above the opening 10. For each transfer out operation, the blow nozzle 29 blows air onto the top surface of the printed product to be transferred out, thus aiding the pull of gravity. The blow nozzle 29 could also be replaced with a suction device arranged below the flap 11, in the space 20. However, other auxiliary means can be used as well, such as mechanical aids for supporting the downward movement of the printed products 3 to be transferred out. In principle, embodiments having neither auxiliary means of this type nor a slide 14 are conceivable as well. In that case, the printed products 3 to be transferred out are removed only through the opening 10 and due to gravity.

As can be seen, an adaptation to the thickness of the printed products 3 is not necessary, thus making it possible to transfer out printed products 3 of varying thickness. The printed products 3 also do not need to be gripped during the transfer out operation, e.g. with the aid of grippers, and thus cannot be damaged. Since the transport device 16 can be positioned underneath the transport channel 2, accessibility to the transport channel 2 is not hindered. The transfer out device according to the invention can be realized with relatively few and robust parts and is additionally operatively sound, even if printed products with different thicknesses are removed successively.

The invention has been described in detail with respect to exemplary embodiments, and it will now be apparent from the foregoing to those skilled in the art that changes and modifications may be made without departing from the invention in its broader aspects, and the invention, therefore, as defined in the appended claims, is intended to cover all such changes and modifications that fall within the true spirit of the invention.

What is claimed is:

1. A transfer out device for a gathering and collating machine, comprising:

a transport channel comprising a transporting device, a guide wall, and a bottom support surface, wherein the transporting device transports printed products through the transport channel in a clocked flow, wherein the guide wall is arranged to abut an edge of the printed products and to guide the printed products through the transport channel, and wherein the bottom support surface extends upwardly away from the guide wall at an angle to support the printed products while the printed products are in the transport channel; and a transfer arrangement to transfer the printed products in a downward direction out of the transport channel, wherein the transfer arrangement comprises an opening in the bottom support surface of the transport channel arranged at a distance from the guide wall.

2. The device according to claim 1, wherein the transfer arrangement comprises a wall section in the bottom support surface of the transport channel movable downward for removing a printed product as soon as the printed product to be transferred out is located in a region of the wall section.

3. The device according to claim 1, wherein the transfer arrangement comprises a wall section in the bottom support surface of the transport channel movable downward and simultaneously away from the guide wall for removing a printed product as soon as the printed product to be transferred out is located in a region of the wall section.

4. The device according to claim 2, wherein the wall section is a pivoting flap.

5. The device according to claim 4, wherein the transporting device defines a transporting direction in which the printed products are transported, and the pivoting flap has a pivot axis extending substantially parallel to the transporting direction of the transport channel.

6. The device according to claim 5, wherein the pivot axis is located proximate to an edge of the transport channel.

7. The device according to claim 1, wherein the transfer arrangement is operative to move the printed products out of the transport channel such that the printed products drop downward with the aid of gravity.

8. The device according to claim 1, wherein the transfer arrangement further comprises an auxiliary device to accelerate the transfer out of the printed products.

9. The device according to claim 8, wherein the auxiliary device comprises a nozzle for blowing air.

10. The device according to claim 1, wherein the transfer arrangement further comprises a slide arranged on the transport channel to push the printed products to be transferred out toward the opening.

11. The device according to claim 10, wherein the transport channel defines:

a transporting direction in which the printed products are transported, wherein the guide wall is located at a side of the transport channel, and wherein the slide is arranged in or behind the guide wall, and is movable crosswise to the transporting direction of the transport channel to transfer out the printed products.

12. The device according to claim 11, wherein the slide has at least one finger arranged, in a rest position, in a recess in the guide wall.

13. The device according to claim 8, wherein the transporting device defines a transporting direction in which the printed products are transported, and the slide moves in the transporting direction with the printed products to be transferred out.

14. A gathering and collating machine, comprising:

a transport channel comprising a transporting device, a guide wall, and a bottom support surface in which printed products are transported in a clocked flow through the transport channel by the transporting device, wherein the guide wall is arranged to abut an edge of the printed products and to guide the printed products through the transport channel, and wherein the bottom support surface extends upwardly away from the guide wall at an angle to support the printed products while the printed products are in the transport channel; and a transfer out device to transfer printed products out of the transport channel, the transfer out device comprising means for transferring the printed products in a downward direction out of the transport channel, wherein the means for transferring comprises an opening in the bottom support surface of the transport channel arranged at a distance from the guide wall.

15. The device according to claim 1, wherein the transporting device comprises a plurality of pushers.

16. The device according to claim 15, wherein the plurality of pushers are mounted on an endless chain and project upward through a slot in the transport channel.

17. The device according to claim 14, wherein the transporting device comprises a plurality of pushers.

18. The device according to claim 17, wherein the plurality of pushers are mounted on an endless chain and project upward through a slot in the transport channel.

19. The device according to claim 1, wherein the angle is acute.

20. The device according to claim 14, wherein the angle is acute.

* * * * *